US010533290B2

(12) United States Patent
Fuentes Flores

(10) Patent No.: US 10,533,290 B2
(45) Date of Patent: Jan. 14, 2020

(54) CONTINUOUS FLOW CITY

(71) Applicant: Jaime Vicente Fuentes Flores, Saltillo (MX)

(72) Inventor: Jaime Vicente Fuentes Flores, Saltillo (MX)

( * ) Notice: Subject to any disclaimer, the term of this patent is extended or adjusted under 35 U.S.C. 154(b) by 0 days.

(21) Appl. No.: 15/865,204

(22) Filed: Jan. 8, 2018

(65) Prior Publication Data

US 2019/0211513 A1 Jul. 11, 2019

(51) Int. Cl.
*E01C 1/00* (2006.01)

(52) U.S. Cl.
CPC ..... *E01C 1/002* (2013.01)

(58) Field of Classification Search
CPC ... E01C 1/00; E01C 1/002; E01C 1/02; E01C 1/04
USPC ..... 404/1
See application file for complete search history.

(56) References Cited

U.S. PATENT DOCUMENTS 3,945,745 A * 3/1976 Chang ..... E01C 1/002 404/1
4,630,961 A * 12/1986 Hellwig ..... E01C 1/04 404/1
4,861,184 A * 8/1989 Mier ..... E01C 1/04 404/1
6,470,633 B2 * 10/2002 Showen ..... E04H 1/00 52/169.1
7,347,642 B1 * 3/2008 Showen ..... E01C 1/002 404/1
7,905,681 B2 * 3/2011 Remy ..... E01C 1/04 404/1

* cited by examiner

*Primary Examiner* — Gary S Hartmann

(57) ABSTRACT

A roadway system of sinusoidal one-way roads which surround individual developed areas. A straight bidirectional road intersect the sinusoidal roadways at locations in which the sinusoidal roadways are substantially tangent to one another and orthogonal to the bidirectional road.

1 Claim, 2 Drawing Sheets

CONTINUOUS FLOW CITY

BACKGROUND OF THE INVENTION

The purpose of this invention is to create a new type of urban design that reduces accidents in a significant manner through the elimination of unnecessary obstacles, such as traffic intersections, traffic lights, stop signs, and boulevards with trees, utility poles, and other obstructions.

This new urban design consists of highways that allow a continuous traffic flow throughout the whole development through the combination of two main elements: Ondulating Highways [1] which are generally sinusoidal roads in plan view, and perpendicular Linear Highways [2].

To achieve an efficient circulation of traffic in all directions, the Ondulating Highways [1] are connected by interchanges [3] placed where the pattern of the Ondulating Highways comes close together.

Linear Highways [2] are used to move in a perpendicular direction. Interchanges [4] that vary in radii (see drawing 1) are used to connect these Linear Highways to the Ondulating Highways [1].

Ondulating Highways [1] are accessed via the Linear Highways [2] through these same interchanges [4].

The design of the Ondulating Highways [1] is one way only. Each Ondulating Highway is formed by three lanes, 4 meters wide each, and a 4 meter wide emergency lane for the entire length of the highway. On each side of the highway is a 10 meter wide area that can be used to exit and avoid accidents. This area can be grassy or covered in another landscape. Also on each side of the highway is an area 30 meters wide for the development of a forest or other scenic landscape.

The design of the Linear Highways [2] is formed by two highways with opposite direction of traffic, separated by a grassy area 40 meters wide. Each highway has 3 lanes, 4 meters wide each, and an emergency lane 4 meters wide on each side for the entire length of the highway.

The 4 meter wide emergency lanes that continue for the entire length of the Ondulating [1] and Linear Highways [2] can be used to merge or descelerate as needed.

The purpose of what is described in the previous three paragraphs is to provide a safer driving experience.

With the above explanations, I affirm that my invention is a new and improved design to build new cities.

DETAILED DESCRIPTION

Figure 1:
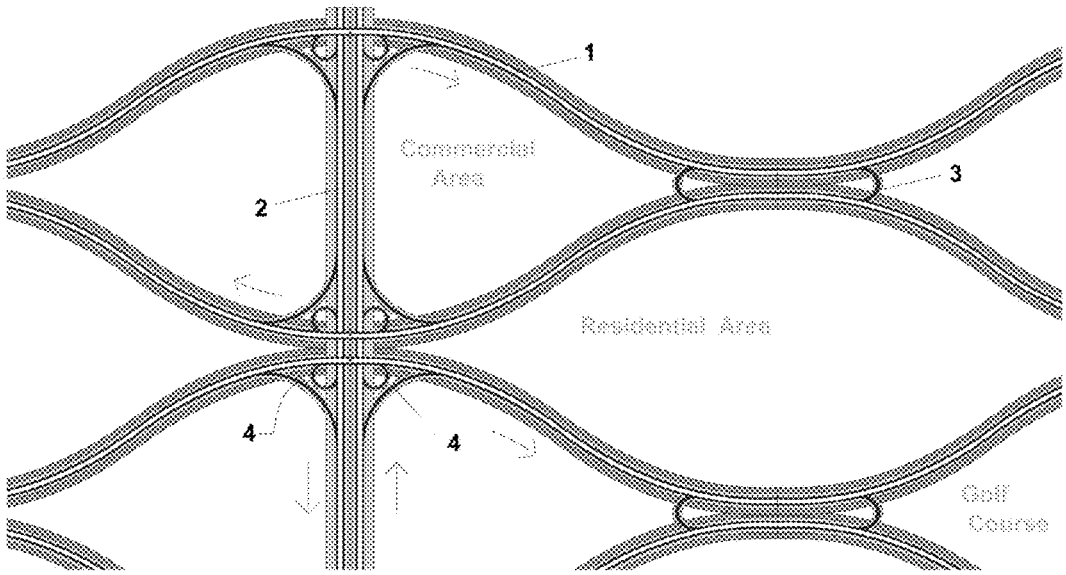
FIG. 1 is a plan view of a roadway system according to the present invention.
Figure 2:
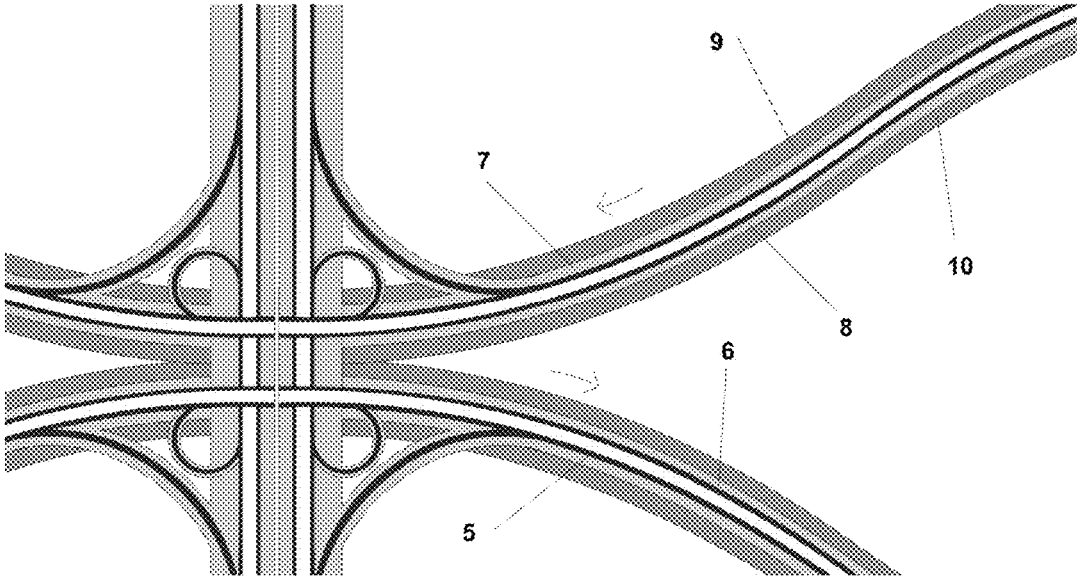
FIG. 2 is a plan view of an interchange between a straight, bidirectional road and two one-way sinusoidal roads.

This invention will be fully understood through the following descriptions of the attached drawings, which are presented just for illustration purposes, and are not limited to the present invention, where:

Drawing 1: This is a view of the design that highlights the one-way Ondulating Highways [1], which are parallel to their mirror image and cover the length of the entire urban development. The Ondulating Highways intersect perpendicularly [1] with the Linear Highways [2].

The Linear Highways [2] repeat in a parallel form and intersect with the Ondulanting Highways [1] in the center of the ocular shape created by the Ondulating Highways [1], as seen on drawing 1, so that this shape is divided into two equal parts.

The Ondulanting Highways [1] are connected to each other by interchanges [3]. The Ondulating Highways [1] are connected to the Linear Highways [2] by semicircular interchanges of two different radii. [4].

Drawing 2: Detail of the one-way Ondulanting Highways [1] with 3 or more lanes, 4 meters wide each, and a 4 meters wide emergency lane [5 & 6] on both sides of each highway.

One continuous flat area 10 meters wide [7 & 8] is placed on each side of the highways for emergency exits or in case of an accident. The area can be grassy or covered in a different type of landscape.

At each side of the Ondulanting Highways is a continuous area 30 meters wide for forest or other scenic landscapes [9 & 10].

This present invention offers a new type of urban design that can be used to develop new cities, add to existing ones, or for industrial use. Ondulanting Highways [1] intersect perpendicularly at different levels with Linear Highways [2], interconnected by interchanges. The Ondulating Highways [1] are parallel and inverted with respect to the other, creating a pattern in the shape of a human eye, wide in the center and narrow at the ends. The Ondulanting Highways [1] never cross each other and are connected by interchanges. The resulting oculiform spaces in between the Ondulating Highways can be used for residential, commercial, agriculture, recreational, etc. or industrial areas. This highway system is repeated in a modular form, infinitively, throughout the whole development, resulting in a continuous flow highway system.

The invention claimed is:

1. A roadway system comprising:

at least a first road, a second road, a third road, a fourth road and a fifth road;

each of said first, second, third and fourth roads being substantially sinusoidal in plan view;

said first and third roads being substantially parallel to one another and arranged to accommodate traffic in a generally first direction;

said second and fourth roads being substantially parallel to one another and arranged to accommodate traffic in a generally second direction, said second direction being substantially opposite to said first direction;

said first and second roads alternately converge towards and diverge away from each other; thereby forming at least one first converging area and at least one first diverging area, respectively;

wherein the at least one first converging area forms at least one substantially parallel section of the first and second roads which is bounded by a U-turn area that enables traffic to transfer between said first and said second roads;

said third and fourth roads alternately converge towards and diverge away from each other; thereby forming at least one second converging area and at least one second diverging area, respectively;

wherein the at least one second converging area forms at least one substantially parallel sections of said third and fourth roads which is bounded by a U-turn area that enables traffic to transfer between said third and said fourth roads;

said second and third roads alternately converge towards and diverge away from each other; thereby forming at least one third converging area and at least one third diverging area, respectively;

said fifth road being arranged to accommodate bidirectional traffic and arranged with interchanges to intersect said first road at a first diverging area; intersect said second and third roads at a third converging area; and intersect said fourth road at a second diverging area, such that the traffic on said fifth road is substantially orthogonal to each of the first and the second directions at interchange locations;

the interchanges formed with respect to said fifth road such that traffic can transfer between said fifth road and each of said first, second, third and fourth roads.

* * * * *